US007117786B2

(12) United States Patent
Nakamura et al.

(10) Patent No.: US 7,117,786 B2
(45) Date of Patent: Oct. 10, 2006

(54) STENCIL PRINTING MACHINE

(75) Inventors: Akira Nakamura, Ibaraki-ken (JP); Taku Naitou, Ibaraki-ken (JP); Hirokazu Kamano, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 49 days.

(21) Appl. No.: 10/927,585

(22) Filed: Aug. 27, 2004

(65) Prior Publication Data

US 2005/0045054 A1 Mar. 3, 2005

(30) Foreign Application Priority Data

Aug. 27, 2003 (JP) ..... P2003-303028

(51) Int. Cl.
*B41L 13/04* (2006.01)
*B41L 13/18* (2006.01)

(52) U.S. Cl. ..... 101/119; 101/118; 101/368

(58) Field of Classification Search ..... 101/119
See application file for complete search history.

(56) References Cited

U.S. PATENT DOCUMENTS 6,789,472 B1 * 9/2004 Nakamura et al. ..... 101/119
2004/0069164 A1 * 4/2004 Nakamura et al. ..... 101/119

FOREIGN PATENT DOCUMENTS

JP 07-132675 5/1995
JP 2001-246828 9/2001

* cited by examiner

*Primary Examiner*—Andrew H. Hirshfeld
*Assistant Examiner*—Joshua Zimmerman
(74) *Attorney, Agent, or Firm*—Nath & Associates PLLC; Gregory B. Kang; Teresa M. Arroyo

(57) ABSTRACT

A stencil printing machine has a rotatable printing drum including an outer peripheral wall of ink impermeable material. A stencil paper is mounted on the surface of the outer peripheral wall. An ink supplying mechanism includes an ink supplying unit in the outer peripheral wall of the printing drum and supplies ink to the surface of the outer peripheral wall. A pressure roller presses a fed print sheet against the outer peripheral wall. When an initial printing operation is performed after a stencil paper is mounted on the printing drum, the ink supplying mechanism is caused to supply the surface of the outer peripheral wall, in advance, with an amount of ink which is larger than an amount of ink which is supplied for second and proceeding printing operations.

6 Claims, 12 Drawing Sheets

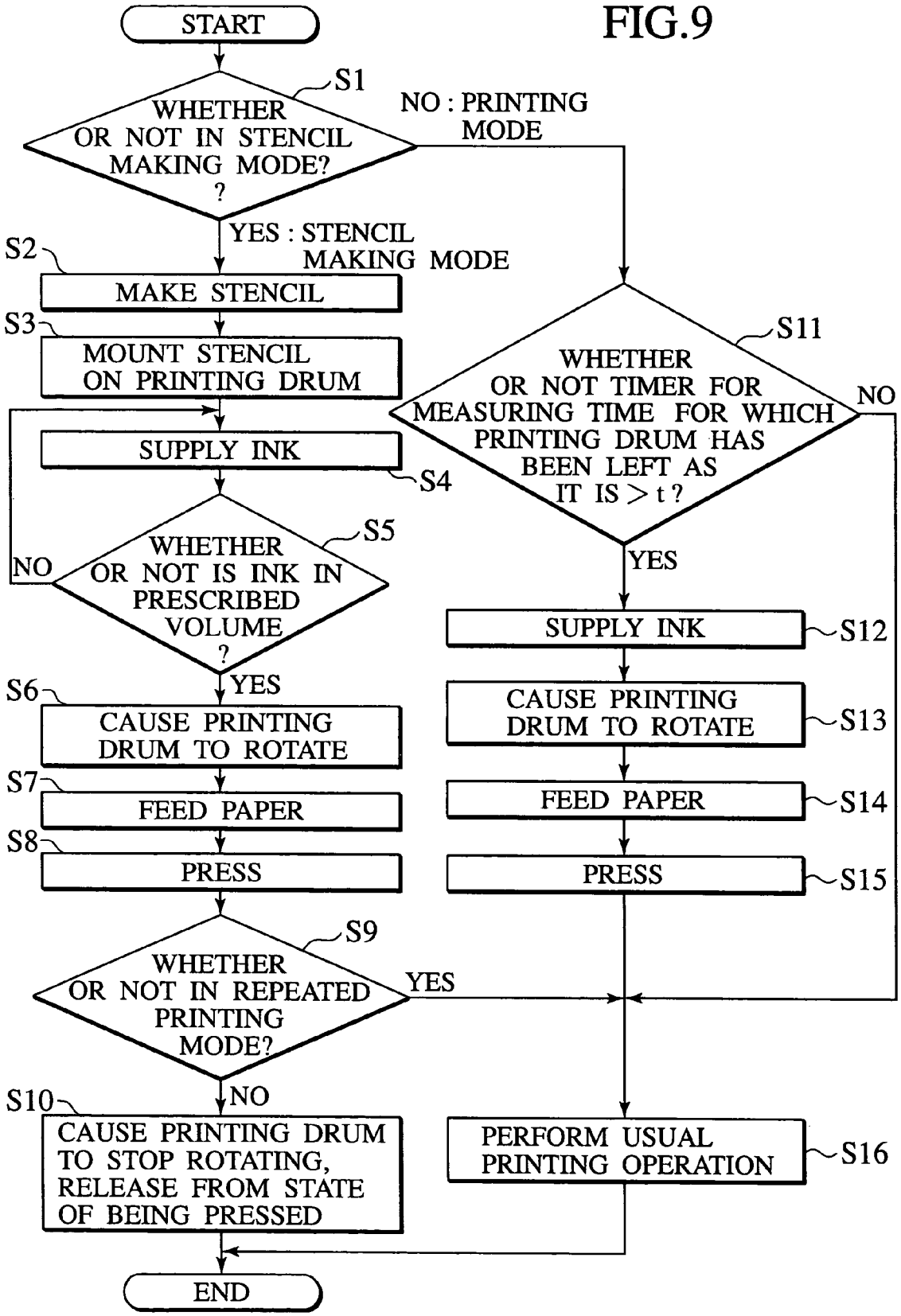
FIG.9
START
S1
WHETHER OR NOT IN STENCIL MAKING MODE? ?
NO : PRINTING MODE
YES : STENCIL MAKING MODE
S2
MAKE STENCIL
S3
MOUNT STENCIL ON PRINTING DRUM
SUPPLY INK
S4
S5
WHETHER OR NOT IS INK IN PRESCRIBED VOLUME ?
NO
YES
S6
CAUSE PRINTING DRUM TO ROTATE
S7
FEED PAPER
S8
PRESS
S9
WHETHER OR NOT IN REPEATED PRINTING MODE?
YES
NO
S10
CAUSE PRINTING DRUM TO STOP ROTATING, RELEASE FROM STATE OF BEING PRESSED
S11
WHETHER OR NOT TIMER FOR MEASURING TIME FOR WHICH PRINTING DRUM HAS BEEN LEFT AS IT IS > t ?
NO
YES
SUPPLY INK
S12
CAUSE PRINTING DRUM TO ROTATE
S13
FEED PAPER
S14
PRESS
S15
PERFORM USUAL PRINTING OPERATION
S16
END

STENCIL PRINTING MACHINE

BACKGROUND OF THE INVENTION

1. Field of the Invention

The present invention relates to a stencil printing machine which transfers ink, transuding out of pores in a stencil paper, to a print medium by transferring the print medium while pressing the print medium against a printing drum on which the stencil paper is mounted.

2. Description of the Related Art

As conventional stencil printing machines of this type, there have been an inner press type (disclosed in Japanese Patent Application Laid-open No. 7-132675) and an outer press type (disclosed in Japanese Patent Application Laid-open No. 2001-246828).

The inner press type will be explained briefly as follows. The inner press type is provided with a printing drum and a back press roller whose diameters are nearly equal. The printing drum and the back press roller are arranged so as to be each capable of being rotated in a state that parts of each of the outer peripheral surfaces of the printing drum and the back press roller are made closely adjacent to each other. The printing drum, whose outer peripheral wall is flexible, is formed of an ink permeable screen. The printing drum is provided, inside the outer peripheral surface, with an ink supplying mechanism which supplies ink to the inner surface of the screen, and which can press the inner surface of the screen by an inner press roller.

Then, the printing drum on which a stencil paper is mounted and the back press roller are caused to be rotated while being synchronized with each other. A print sheet is fed between the rotated printing drum and the rotated back press roller. Thence, the inner press roller presses the screen. By the pressing, the print sheet is transferred between the back press roller and the stencil paper while being pressed against, and brought into contact with, the back press roller and the stencil paper. In the process of this transfer, ink on the side of the screen is transferred, out of pores in the stencil paper, onto the print sheet. Accordingly, an image is printed onto the print sheet.

In addition, the outer press type will be described briefly as follows. The outer press type is provided with a printing drum. The outer peripheral wall of the printing drum is formed of a porous, ink permeable member. The printing drum is provided, inside, with an ink supplying mechanism which supplies ink to the ink permeable member, and outside, with a pressure roller.

Then, the printing drum on which a stencil paper is mounted is caused to be rotated, and a print sheet is fed between the rotated printing drum and the rotated presser roller. Thence, the pressure roller presses the printing drum. By the pressing, the print sheet is transferred between the pressure roller and the stencil paper while being pressed against, and brought into contact with, the pressure roller and the stencil paper. In the process of this transfer, ink on the side of the printing drum is transferred, out of pores in the stencil paper, onto the print sheet. Accordingly, an image is printed onto the print sheet.

With regard to each of the above-described, conventional, inner and outer press types of stencil printing machines, however, an ink pool is formed in the ink supplying mechanism located inside the printing drum, and ink in the ink pool is supplied to the printing drum in the course of a printing operation. Consequently, when the printing is not performed for a long time, ink held in the ink pool and ink staining in the printing drum are left in a state of being exposed to the atmosphere for a long time. This causes a problem of the ink being changed in quality.

In addition, since various rollers for supplying ink have to be arranged inside the printing drum, this causes a problem of making it difficult to miniaturize, and to reduce the weight of, the printing drum.

Against this background, the applicant of the present invention has developed a stencil printing machine comprising: a printing drum, which is capable of being rotated, which includes an outer peripheral wall formed of ink impermeable material, and on which a stencil paper is mounted around the surface of the outer peripheral wall; an ink supplying mechanism, which includes an ink supplying unit in the outer peripheral wall of the printing drum, and which supplies ink from the ink supplying unit to the surface of the outer peripheral wall; a pressure roller which presses the fed print medium against the surface of the outer peripheral wall.

In this stencil printing machine, when the outer peripheral wall is caused to be rotated and a print medium is fed in a state that ink is supplied from the ink supplying unit to the surface of the outer peripheral wall, this print medium is transferred while being pressed against the stencil paper and the outer peripheral wall of the printing drum by the pressure roller. Concurrently, ink supplied between the outer peripheral wall of the printing drum and the stencil paper is caused, by the pressure of the pressure roller, to be spread downstream in the printing direction while being squeezed through in-between. In addition, the spread ink transudes out of pores in the stencil paper, and is transferred onto the print medium, whereby an image is printed onto the print medium. Ink which has been supplied to the outer peripheral wall of the printing drum is held in a virtually airtight space between the outer peripheral wall of the printing drum and the stencil paper, and the exposure of the ink to the atmosphere is minimized. Furthermore, various rollers for supplying ink need not be arranged in the interior of the printing drum. As a consequence, ink will not be changed in quality even when the printing is not performed for a longtime. Thus, the printing drum can be miniaturized, and the weight can be reduced.

With regard to the stencil printing machine, however, ink has not been supplied to the inner surface of a new stencil paper which has just been mounted on the printing drum. For this reason, it is highly likely that, if the same amount of ink as is used for usual printing operations is supplied to the stencil paper at this moment, the ink does not cover the entire printing surface of the stencil paper fully while an initial printing operation is performed. Since, therefore, printed sheets which include places that are not fully printed are produced, trial printings have to be repeated until printed sheets which meet a desired quality are brought about. In some cases, print sheets have been wasted.

In addition, ink which is held in the inner surface of the stencil paper is not completely free from the exposure to the atmosphere, although the exposure of the ink to the atmosphere is suppressed as little as possible as prescribed above. If, therefore, the printing drum is left in a state that a stencil paper is mounted on the printing drum for a long time, ink on the surface of the printing drum transudes out through pores in the stencil paper or does other things. In a case that printing operations are resumed while in a state that the printing drum has been left as it is for a long time, it is highly likely that ink does not fully cover the entire printing surface as long as the ink to be supplied is in the same amount as is used for usual printing operations. Since, therefore, printed sheets which include places that are not fully printed are produced, trial printings have to be repeated until printed sheets which meet a desired quality are brought about. In some cases, print sheets have been wasted.

SUMMARY OF THE INVENTION

An object of the present invention is to provide a stencil printing machine which offers a printed sheet that does not include places that are not fully printed or an equivalence when an initial printing operation is performed after a stencil paper has been mounted on the printing drum or after the printing drum has been left as it is for a long time.

A first aspect of the present invention provides a stencil printing machine comprising: a rotatable printing drum including an outer peripheral wall of ink impermeable material, wherein a stencil paper is mounted on the surface of the outer peripheral wall; an ink supplying mechanism including an ink supplying unit in the outer peripheral wall of the printing drum, configured to supply ink from the ink supplying unit to the surface of the outer peripheral wall; and a pressure roller configured to press a fed print medium against the outer peripheral wall, wherein, for an initial printing operation after a stencil paper is mounted on the printing drum, the ink supplying mechanism is configured to supply the surface of the outer peripheral wall with an amount of ink which is larger than an amount of ink which is supplied for second and proceeding printing operations.

In this stencil printing machine, when an initial printing operation is performed, the inner surface of the stencil paper is supplied with an amount of ink which is larger than an amount of ink which is supplied for usual printing operations. Since the ink is spread downstream in the printing direction by being squeezed through by the pressure roller, the ink covers the entire printing surface. Accordingly, a printed sheet which does not include places that are not fully printed is available at a time when an initial printing operation is performed after the stencil paper is mounted on the printing drum. As a consequence, waste of print sheets can be avoided.

A second aspect of the present invention provides a stencil printing machine comprising: a rotatable printing drum including an outer peripheral wall of ink impermeable material, wherein a stencil paper is mounted on the surface of the outer peripheral wall; an ink supplying mechanism including an ink supplying unit in the outer peripheral wall of the printing drum, configured to supply ink from the ink supplying unit to the surface of the outer peripheral wall; and a pressure roller configured to press a fed print medium against the outer peripheral wall, wherein, for an initial printing operation after a time period from a time at which the printing drum is caused to stop operating through a time at which the initial printing operation is started exceeds a prescribed length of time, the ink supplying mechanism is configured to supply the surface of the outer peripheral wall with an amount of ink which is larger than an amount of ink which is supplied for second and proceeding printing operations.

In this stencil printing machine, if the printing drum has been left as it is for a long time, ink on the surface of the printing drum transudes through pores in the stencil paper, or does other things. If, however, a time period for which the printing drum has been left as it is exceeds a prescribed length of time, the inner surface of the stencil paper is supplied with an amount of ink which is larger than an amount of ink which is supplied for usual printing operations, when an initial printing operation is performed. Since the ink is spread downstream in the printing direction by being squeezed through by the pressure roller, the ink covers the entire printing surface. Accordingly, even though the printing drum has been left as it is for a long time, a printed sheet which does not include places that are not fully printed is available at a time when an initial printing operation is performed. As a consequence, waste of print sheets can be avoided.

An amount of ink, which is supplied when an initial printing operation is performed after the stencil paper has been mounted on the printing drum or after the printing drum has been left as it is for a long time, may be arranged to be larger than an average amount of ink which is held in the inner surface of the stencil paper after a printing operation is completed.

For this stencil printing machine, an amount of ink which is supplied when an initial printing operation is performed is almost equivalent to an aggregation of an amount of ink which is held in the inner surface of the stencil paper after being squeezed through by the pressure roller and an amount of ink which is transferred to a print medium. By this, this means that a sufficient amount of ink is supplied at a time of an initial printing operation. Accordingly, a printed sheet which does not include places that are not fully printed can be surely available even when an initial printing operation is performed.

BRIEF DESCRIPTION OF THE DRAWINGS

FIG. 9 is a flowchart of operations in a stencil making mode and a printing mode to show the embodiment of the present invention.

DETAILED DESCRIPTION OF THE PREFERRED EMBODIMENT

An embodiment of the present invention will be described hereinafter with reference to the accompanying drawings.

Figure 1:
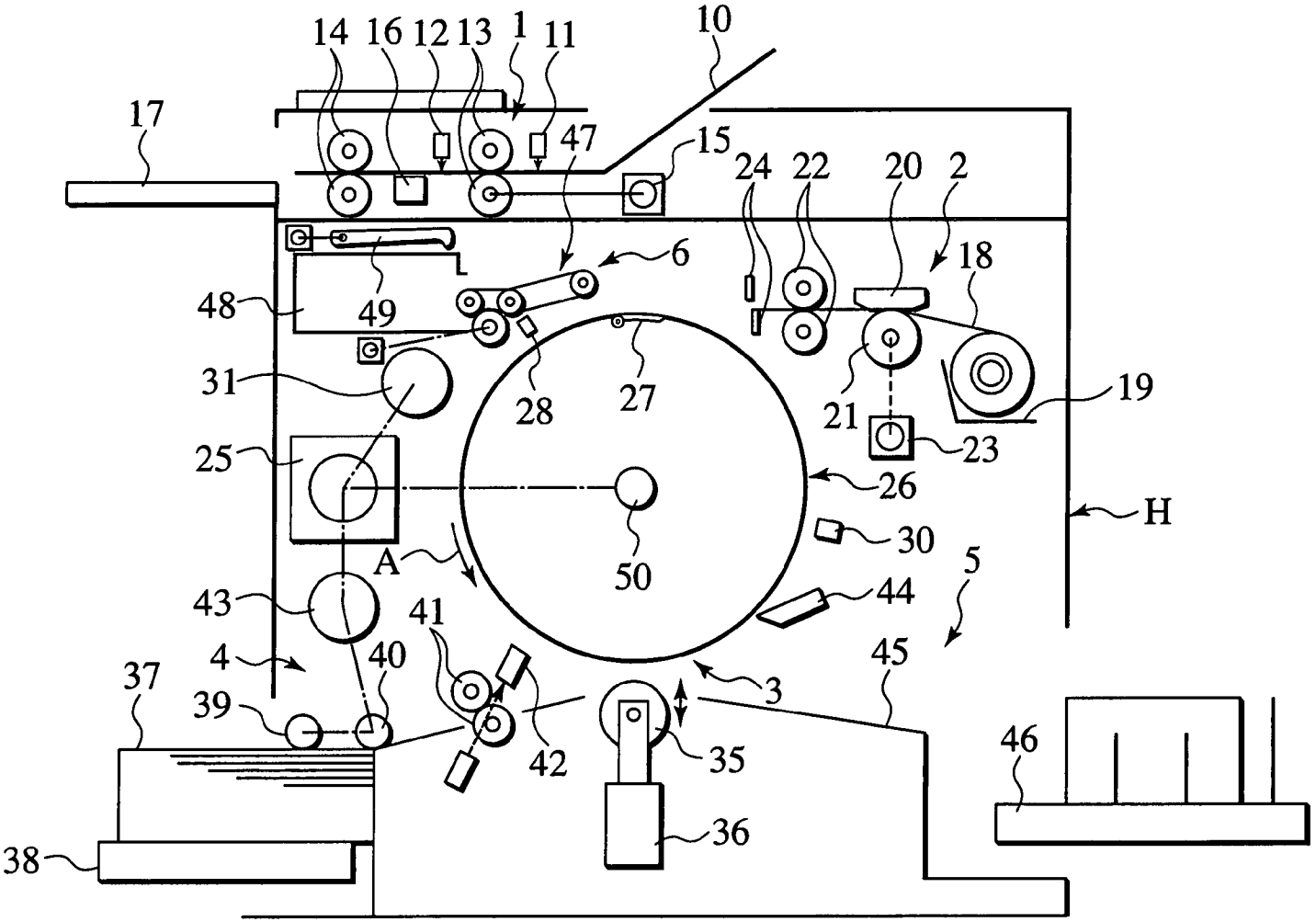
FIG. 1 is a schematic block diagram of a stencil printing machine to show an embodiment of the present invention.

As shown in FIG. 1, a stencil printing machine is constituted mainly of an original scanning unit 1, a stencil making unit 2, a printing unit 3, a paper feeding unit 4, a paper discharging unit 5, and a stencil discharging unit 6.

The original scanning unit 1 comprises: an original setup rack 10 on which an original to be printed is fed; original detection sensors of a reflective type 11 and 12 for checking whether or not the original is on the original setup rack 10; original leading rollers 13 and 14 for transferring the original which has been fed on the setup rack 10; a stepping motor 15 for causing the original leading rollers 13 and 14 to be driven and rotated; an image sensor of contact type 16 for optically scanning image data of the original to be transferred by the original leading rollers 13 and 14, and for converting the image data into electric signals; and an original discharging tray 17 on which an original to be discharged from the original setup rack 10 is fed. In addition, the original which has been fed on the original setup rack 10 is transferred by the original leading rollers 13 and 14, and the image data of the original thus transferred is acquired by the image sensor 16.

The stencil making unit 2 comprises: an original containing unit 19 which contains a roll of a long stencil paper 18; a thermal print head 20 which is arranged downstream of transferring from the original containing unit 19; a platen roller 21 which is arranged in a place opposite to the thermal print head 20; a pair of stencil transferring rollers 22 and 22 which are arranged downstream of transferring from the platen roller 21 and the thermal print head 20; a light pulse motor 23 for causing the platen roller 21 and the pair of stencil transferring rollers 22 and 22 to be driven and rotated; and a stencil cutter 24 which is arranged downstream of transferring from the pair of stencil transferring rollers 22 and 22.

In addition, the long stencil paper 18 is transferred by the rotations of the platen roller 21 and the stencil transferring rollers 22 and 22, and the stencil paper 18 is perforated according to heat sensitiveness in a way that each of dotted heat generators of the thermal print head 20 performs a selective operation of generating heat based on the image data acquired by the image sensor 16. Accordingly, a stencil paper 18 is made. The stencil paper 18 thus made is cut, by a stencil cutter 24, into a stencil paper 18 of a prescribed length.

The printing unit 3 comprises: a printing drum 26 which is caused by a driving force of a main motor 25 to be rotated in the direction indicated by an arrow A in FIG. 1; a stencil clamping unit 27, installed onto the outer peripheral surface of the printing drum, for clamping the edge of the stencil paper 18; a stencil loading sensor 28 for checking whether or not the stencil paper 18 is wound around, and mounted on, the outer peripheral surface of the printing drum 26; a reference position detecting senor 30 for detecting the reference position of the printing drum 26; and a rotary encoder 31 for detecting the revolution of the main motor 25. The rotating position of the printing drum 26 is configured to be enabled to be detected by detecting an output pulse of the rotary encoder 31 based on an output detected by the reference position detecting sensor 30.

Further, the printing unit 3 comprises a pressure roller 35 which is arranged in a place below the printing drum 26. The pressure roller 35 is configured to be capable of providing displacement between a pressing position where the pressure roller is pressed against the outer peripheral surface of the printing drum 26 by a driving force caused by a solenoid device 36 and a resting position where the pressure roller is separated away from the outer peripheral surface of the printing drum 26. The pressure roller 35 is always positioned in the pressing position during the period of being in a printing mode (including a trial print mode), and is positioned in the resting position during the period of being in a mode other than the printing mode.

The edge of the stencil paper 18 to be transferred from the stencil making unit 2 is clamped by the stencil clamping unit 27, and the stencil paper 18 is wound around, and mounted on, the outer peripheral surface of the printing drum 26 by rotating the printing drum 26 in a state that the edge of the stencil paper is clamped. Afterwards, the print sheet 37 (i.e. a print medium) to be fed from the paper feeding unit 4 while being synchronized with the rotation of the printing drum 26 is pressed by the pressure roller 35 against the stencil paper 18 which has been wound around the printing drum 26. By this, an image is printed in a way that ink 56 oozing out of the pores in the stencil paper 18 is transferred onto the print sheet 37.

The paper feeding unit 4 comprises: a paper feed tray 38 on which print sheets 37 are laid in a stack; primary paper feeding rollers 39 and 40 which feed from the paper feed tray 38 only a print sheet 37 which is located at the top of the stack; a pair of secondary paper feeding roller 41 and 41 that feed the print sheet 37, which has been fed by the primary paper feeding rollers 39 and 40, between the printing drum 26 and the pressure roller 35 while being synchronized with the rotation of the printing drum 26; and a paper detection sensor 42 for checking whether or not the print sheet 37 has been fed between the pair of secondary paper feeding rollers 41 and 41. The primary paper feeding rollers 39 and 40 are configured in a way that the revolution of the main motor 25 is selectively transmitted to the primary paper feeding rollers 39 and 40 through a paper feeding clutch 43.

The paper discharging unit 5 comprises: a paper separator 44 for separating a print sheet 37, which has been processed for printing, from the printing drum 26; a transferring passage 45 in which the print sheet 37 which has been separated away from the printing drum 26 by the paper separator 44 is transferred; and a paper receiving tray 46 on which the print sheet 37 that has been discharged from the transferring passage 45 is fed.

The stencil discharging unit 6 comprises: a discharged stencil transferring unit 47 for guiding the edge of the stencil paper 18, which has been released from a state of being clamped to the outer peripheral surface of the printing drum 26, and for transferring the used stencil paper thus guided while separating the used stencil paper from the printing drum 26; a stencil disposal box 48 for containing the stencil paper 18 which has been transferred by the discharged stencil transferring unit 47; and a discharged stencil compressing member 49 for pressing into the back of the stencil disposal box 48 the stencil paper 18 which has been transferred to the inside of the stencil disposal box 48 by the discharged stencil transferring unit 47.

Figure 2:
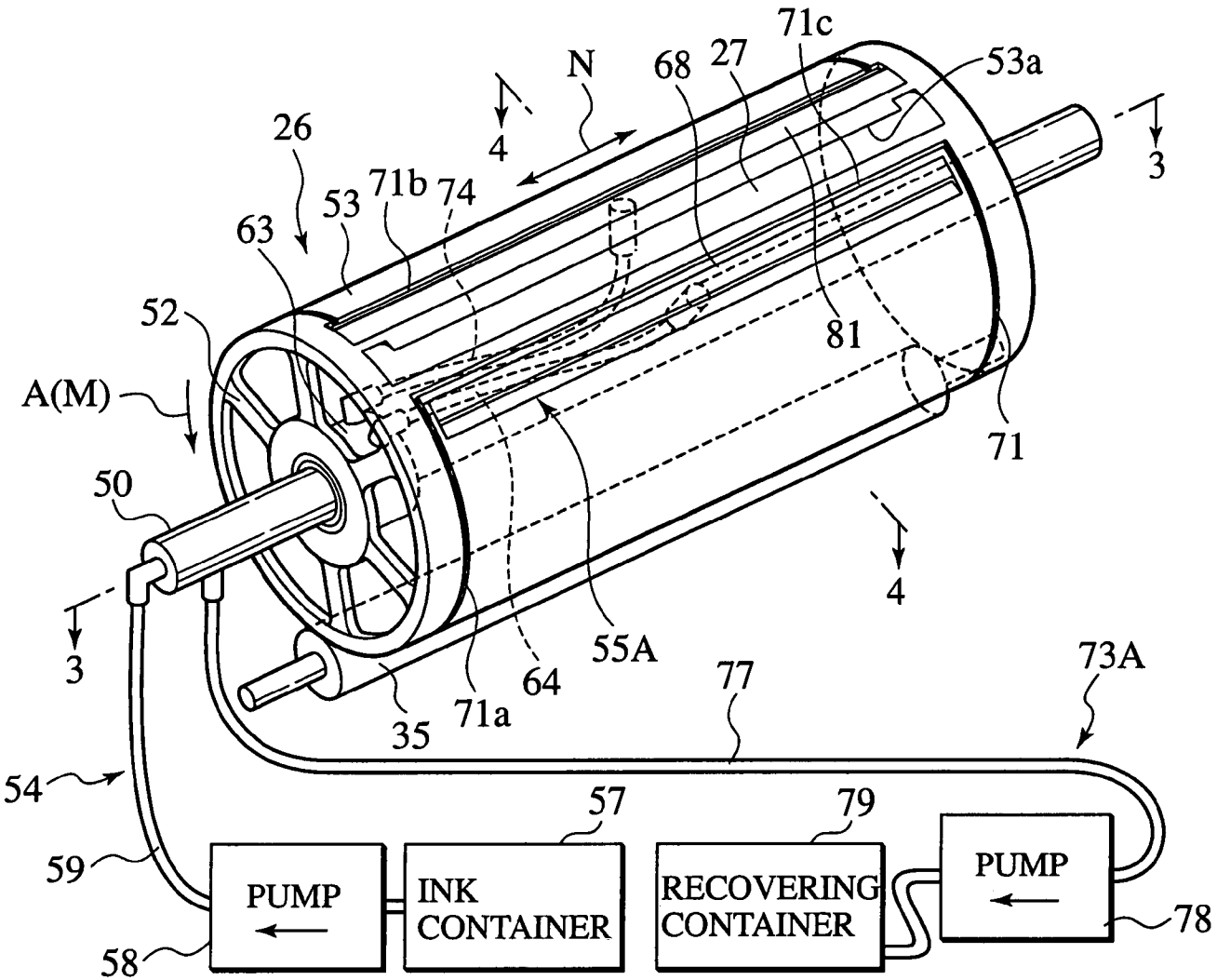
FIG. 2 is a perspective view of a printing drum to show the embodiment of the present invention.
Figure 3:
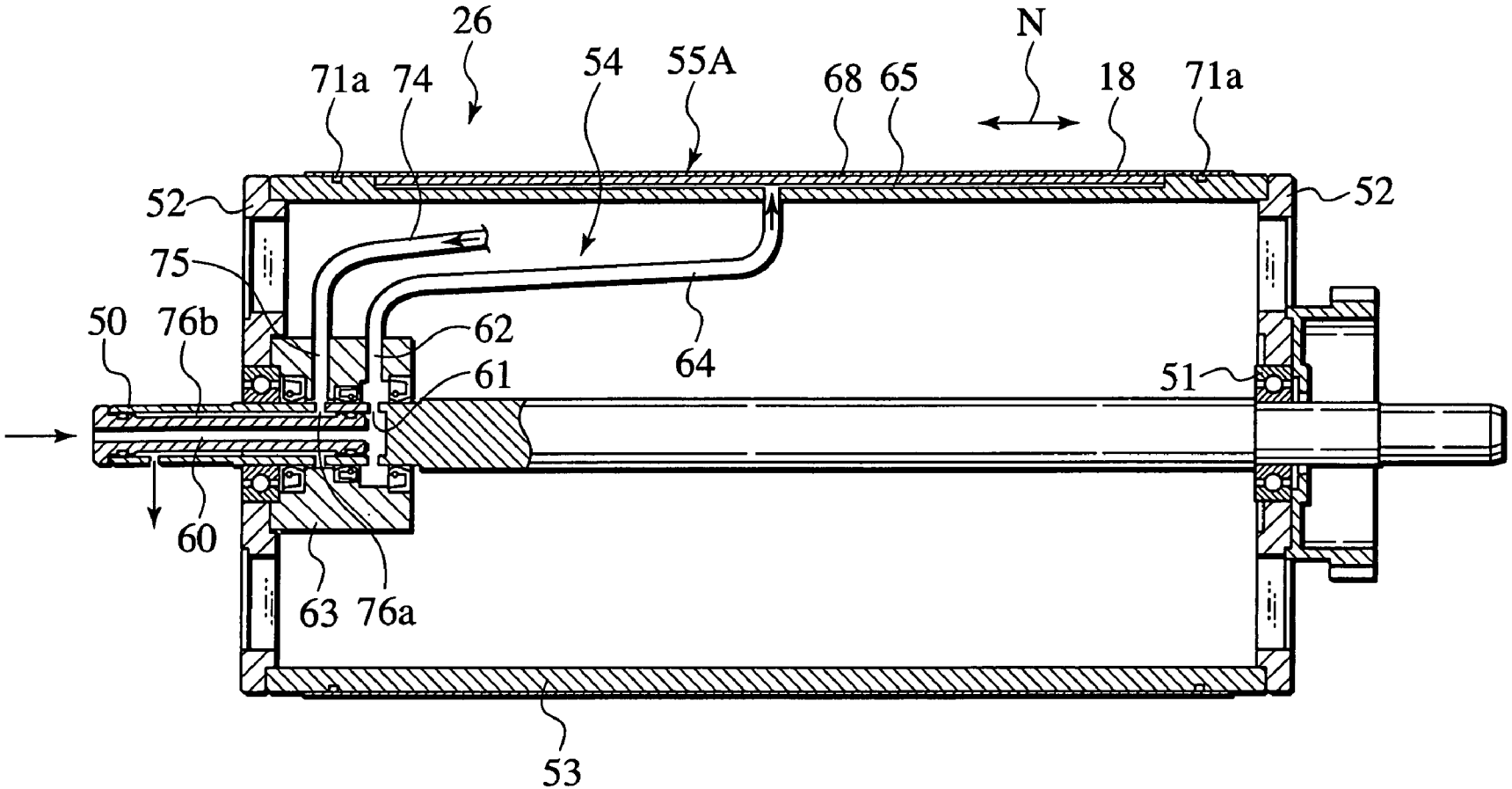
FIG. 3 is a cross sectional view taken along the line 3—3 of FIG. 2 to show the embodiment of the present invention.
Figure 4:
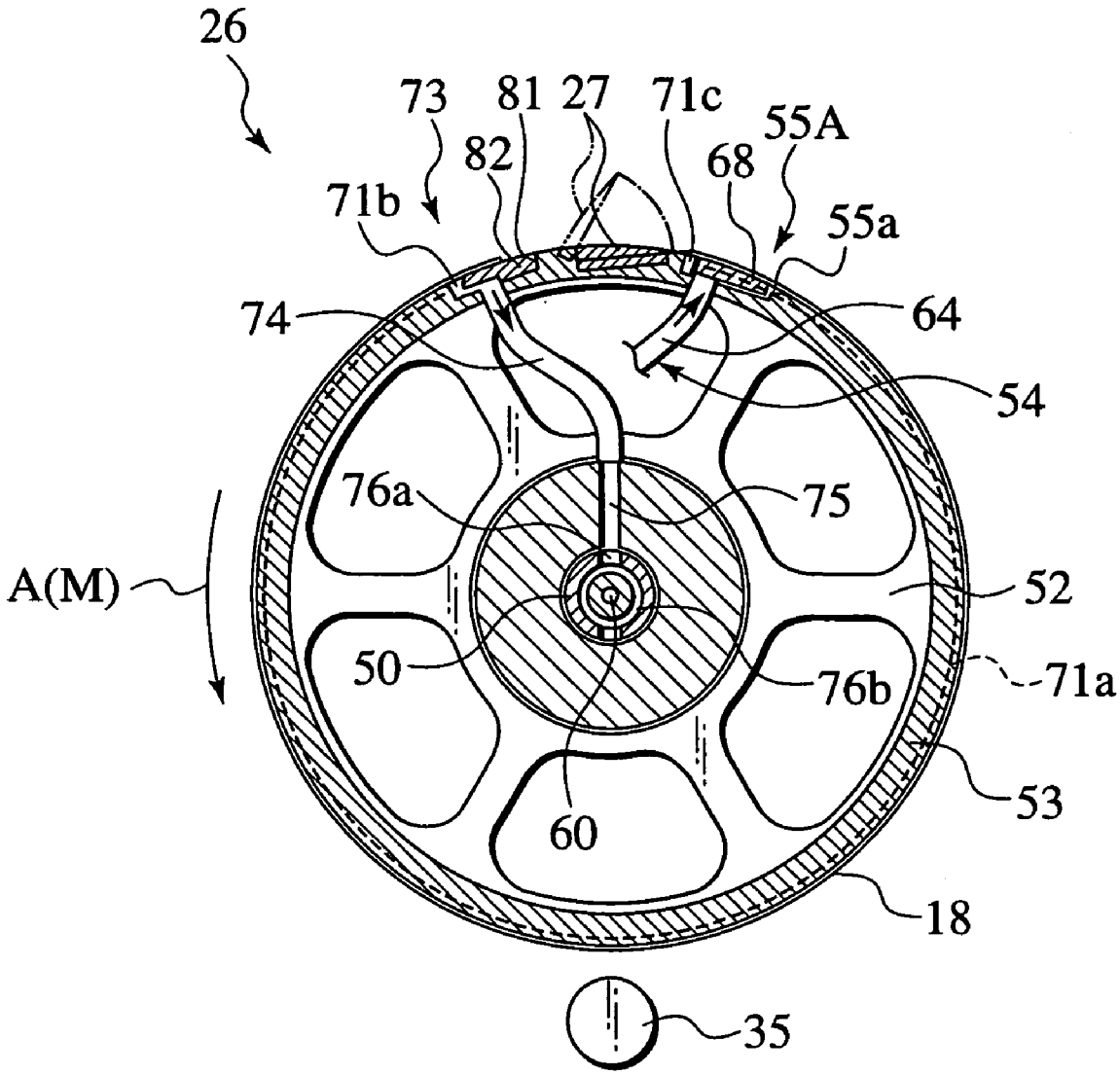
FIG. 4 is a cross sectional view taken along the line 4—4 of FIG. 2 to show the embodiment of the present invention.

As shown in FIG. 2 to FIG. 4, the printing drum 26 comprises: a main shaft 50 which is fixed to the main body H of the stencil printing machine (illustrated in FIG. 1) ; a pair of side discs 52 and 52 which are supported by the main shaft 50 so as to be capable of being rotated while respectively riding on bearings 51; and an outer peripheral wall 53, shaped like a cylinder, which is fixed in-between the pair of side discs 52 and 52. This outer peripheral wall 53 is configured to be integrated with the pair of side discs 52 and 52, and to be driven and rotated by a revolving force of the main motor 25. In addition, the outer peripheral wall 53 is formed of ink impermeable material which is rigid, and which does not allow ink 56 to permeate through. Furthermore, the outer peripheral surface of the outer peripheral wall 53 is coated with Teflon (a registered trade mark), and is formed into a cylindrical even surface without dents or protrusions.

The stencil clamping unit 27 is provided to a concave portion 53*a* for the clamping, which is formed in the axial direction of the main shaft 50 of the outer peripheral wall 53. With regard to the stencil clamping unit 27, one end thereof is supported by the outer peripheral wall 53 so as to be capable of being rotated, and projects from the outer peripheral wall 53 while being released from a state of being clamped, which is indicated with imaginary lines in FIG. 4. The end is configured so that the end does not stick out of the outer peripheral wall 53 while in a state of being clamped, which is indicated with solid lines in FIG. 4. As a consequence, the stencil clamping unit 27 is configured so that the stencil clamping unit can clamp the stencil paper 18 without sticking out of the outer peripheral wall 53.

This outer peripheral wall 53 is caused to be rotated in the direction indicated with an arrow A(M) in FIG. 2 and FIG. 4, and a position where the outer peripheral wall rotates a little away from the stencil clamping unit 27 is defined as the point from which the printing is started. Accordingly, the direction A of the rotation becomes equivalent to the direction M of the printing, and an area below the point from which the printing is started is assigned as a printing area. In this embodiment of the present invention, the maximum printing area is set up in an area in which an A3 sized sheet can be printed. In addition, an ink supplying unit 55A of an ink supplying mechanism 54 is provided to a place upstream of the maximum printing area in the direction M of the printing.

A shown in FIG. 2 to FIG. 5, the ink supplying mechanism 54 comprises: an ink container 57 for containing ink 56; an ink pump 58 for sucking up the ink 56 which is contained in the ink container 57; a first pipe 59 for supplying the ink 56 which has been sucked up by the ink pump 58; the main shaft 50, which one end of the first pipe 59 is connected to, which an ink passage 60 is formed in, and where a hole 61 is formed in a place diametrically opposite; a rotary joint 63, which is supported by the outer periphery of the main shaft 50 so as to be capable of being rotated, and where a communicating hole 62 that can communicate with the hole 61 is formed; a second pipe 64, one end of which is connected to the rotary joint 63, and the other end of which is guided to the outer peripheral wall 53; and an ink supplying unit 55A to which the other end of the second pipe 64 is open. The ink passage 60, the hole 61, 62 and the second pipe 64 constitute a conduit for supplying ink to the ink supplying unit 55A from the inside of the printing drum 26 without exposing the ink to the atmosphere. The ink supplying unit 55A is configured to supply ink from the second pipe 64 into a space between the stencil paper 18 and the outer peripheral wall 53 of the printing drum 26 without exposing the ink to the atmosphere.

Figure 6:
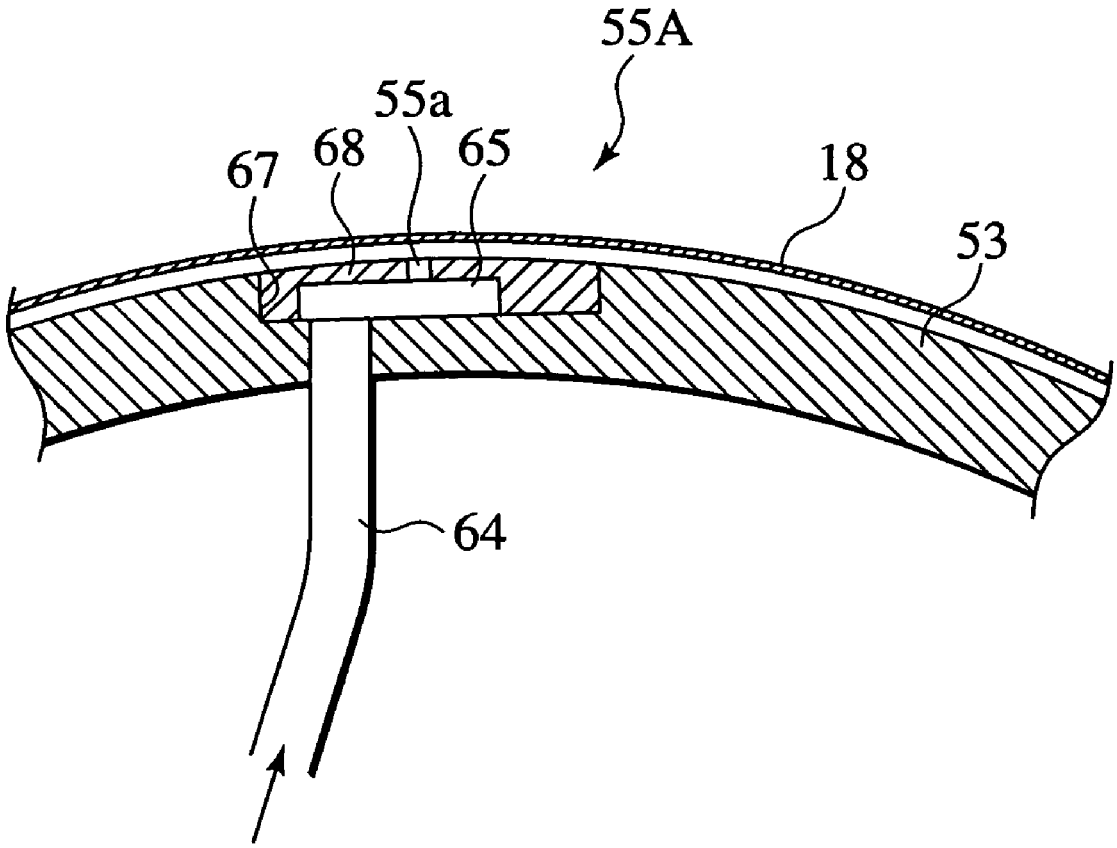
FIG. 6 is magnified, cross sectional view of the vicinity of an ink supplying unit to show the embodiment of the present invention.

The ink supplying unit 55A comprises: an ink dispersing groove 65 (illustrated in FIG. 6) for dispersing the ink 56 (illustrated in FIG. 10), which comes from the second pipe 64, in the direction N orthogonal to the printing direction M; an ink supplying outlets 55*a*, one end of which is open in a place at a distance away from the ink dispersing groove 65 and in the direction N orthogonal to the printing direction M, and the other end of which is open to the surface of the outer peripheral wall 53. As shown in FIG. 6, the ink dispersing groove 65 and the plurality of ink supplying outlets 55*a* are configured of a concave portion 67 for ink supply which is formed in the outer peripheral wall 53 in the direction N orthogonal to the printing direction M and an ink distributing member 68 which is arranged in the concave portion. The plurality of ink supply outlets 55*a* are arrayed in the direction N orthogonal to the printing direction M, and are configured to supply ink 56 almost evenly to the outer peripheral wall 53 in the direction N orthogonal to the printing direction M.

Figure 7:
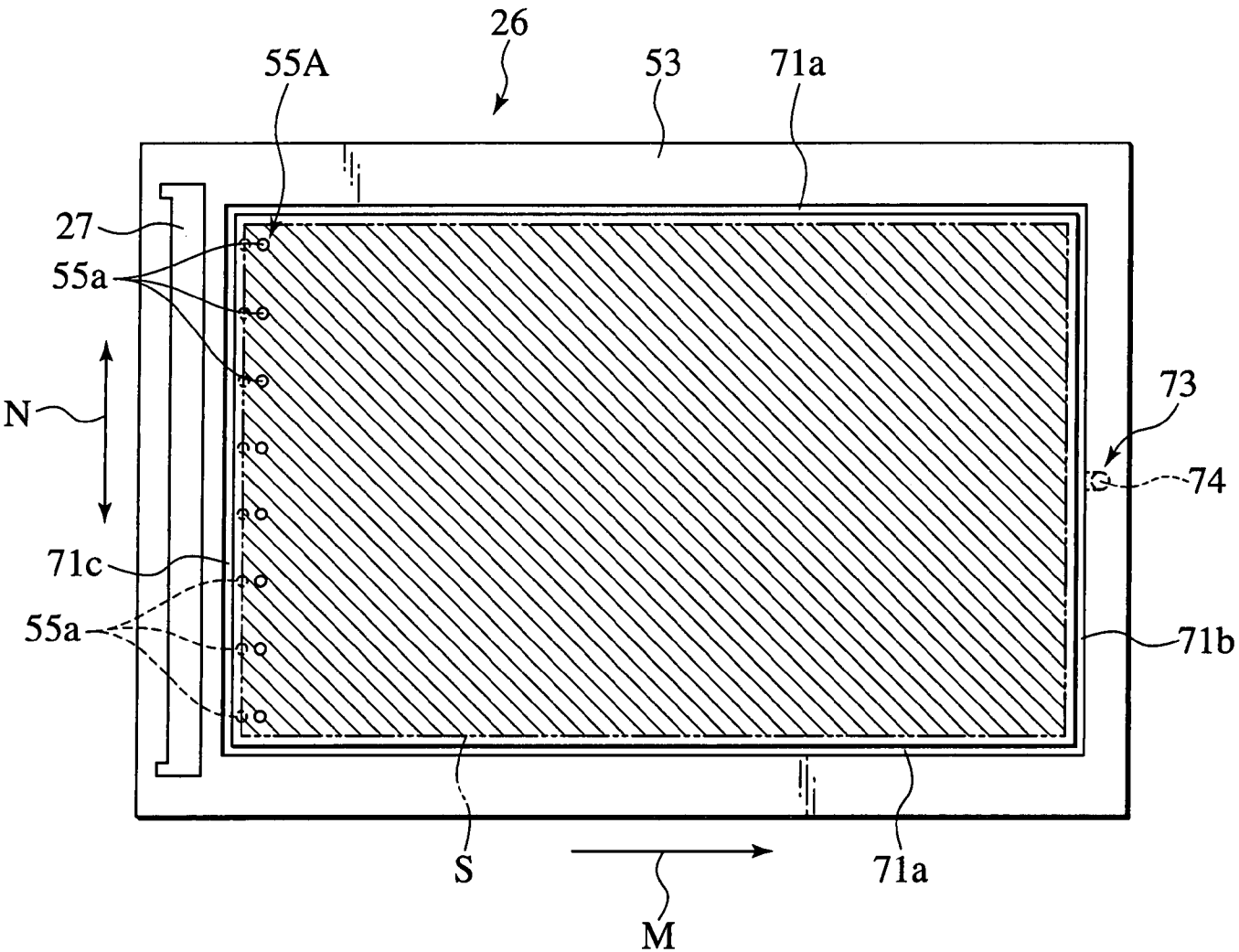
FIG. 7 is an expanded view of the outer peripheral wall of the printing drum to show the embodiment of the present invention.

Here, the most upstream position of the printing in the maximum printing area S in which the ink supplying unit 55A is arranged means a concept, literally including the most upstream position of the printing inside the maximum printing area S (a position which the ink supplying outlets 55*a* are illustrated with solid lines in FIG. 7), and additionally including the position on the border line which sections the maximum printing area S off the further upstream area in which a printing is not made (a position which the ink supplying outlets 55*a* are illustrated with broken lines in FIG. 7). In addition, the most upstream position of the printing in the maximum printing area S with which the ink supplying outlets 55*a* are provided is defined, specifically, as a range in which ink that is supplied to the surface of the outer peripheral wall 53 can spread out at a minimum towards the border line which sections the maximum printing area S off the further upstream area in which a printing is not made.

As shown in FIG. 2 to FIG. 5, an ink recovering mechanism 73 comprises: grooves 71*a*, 71*b* and 71*c* for preventing ink leak which are arranged, as if the sides of a rectangle, throughout the outer periphery of the maximum printing area S of the outer peripheral wall 53; a third pipe 74, one end of which is open to the groove 71*b* for preventing ink leak; the rotary joint 63, which the other end of the third pipe 74 is connected to, and which a communicating hole 75 is formed in; the main shaft 50, by which the rotary joint 63 is supported so as to be capable of being rotated, where a hole 76*a* with which the communicating hole 75 can communicate is formed, and in whose interior an ink passage 76*b* is formed; a fourth pipe 77, one end of which is connected to the main shaft 50; an ink pump 78 (e.g. a trochoid pump), which is placed in the middle of the fourth pipe 77, and which sucks up the ink 56 which stays in the fourth pipe 77; and a recovering container 79, to which the other end of the fourth pipe 77 is connected.

Figure 5:
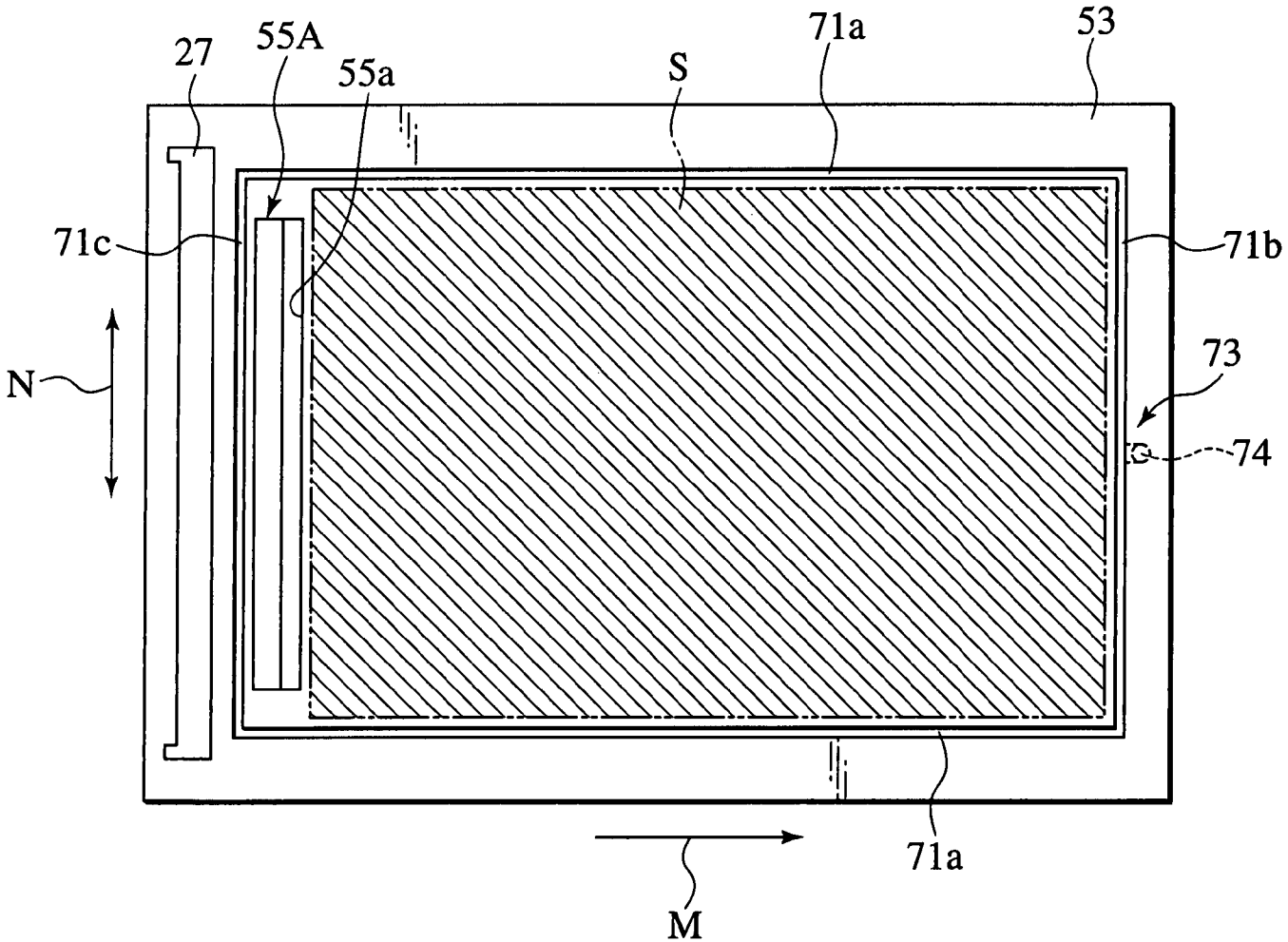
FIG. 5 is an expanded diagram of the outer peripheral wall of the printing drum to show the embodiment of the present invention.

As shown in FIGS. 5 and 7, the groove 71 for preventing ink leak are formed on the right and left sides out of the maximum printing area S in the printing direction M. The groove 71*b* for preventing ink leak is formed in a printed place downstream of the maximum printing area S so as to be extended in the direction N orthogonal to the printing direction M. The groove 71*c* for preventing ink leak is formed, in a printed place upstream of the ink supplying outlets 55*a* which are located upstream of the maximum printing area S, so as to be extended in the direction N orthogonal to the printing direction M. These grooves 71*a*, 71*b* and 71*c* for preventing ink leak communicate with each other at the edges thereof.

The rotary joint 63 is also used for the ink supplying mechanism 54. Since the main shaft 50 is also used for the ink passage of the ink supplying mechanism 54, the main shaft 50 is constructed of a double pipe.

Figure 8:
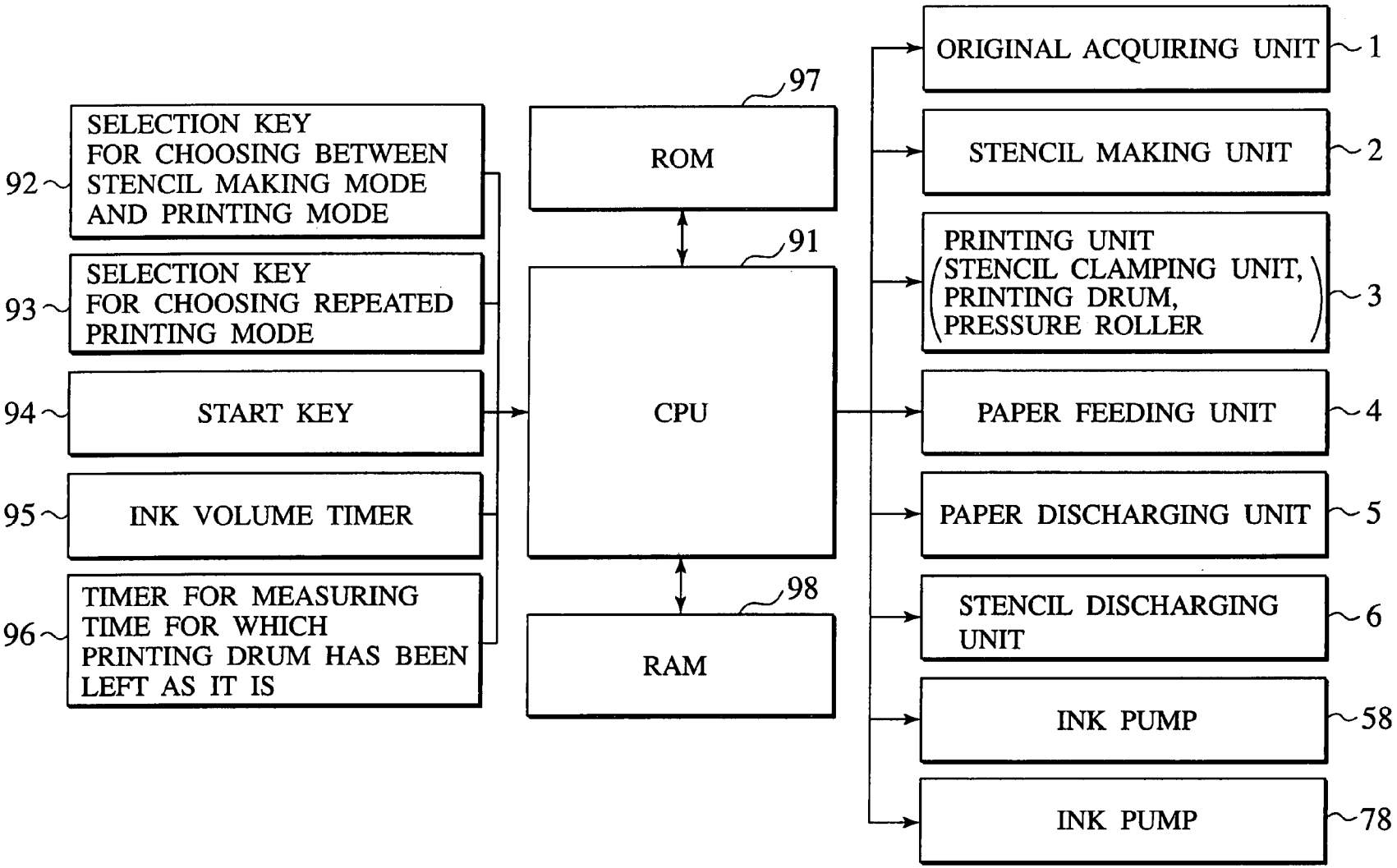
FIG. 8 is a block diagram of a schematic circuit of the stencil printing machine to show the embodiment of the present invention.

Next, a control system for the stencil printing machine will be described. As shown in FIG. 8, a central processing unit (CPU) 91 is guided by data from a selection key 92 for choosing between a stencil making mode and a printing mode, a key 93 for choosing a continuous operating mode, a start key 94 and the like, and systemically controls the original scanning unit 1, a stencil making unit 2, a printing unit 3, a paper feeding unit 4, a paper discharging unit 5 and a stencil discharging unit 6 based on these inputted data, and concurrently controls operations of the ink pumps 58 and 78. In addition, the CPU 91 controls an ink volume timer 95 and a timer 96 for measuring a time period for which the printing drum has been left as it is, and acquires time data from these timers. The ink volume timer 95 is to measure a time needed for supplying ink at an initial printing operation after a stencil paper 18 is mounted on the printing drum 26 or after a time period for which the printing drum has been left as it is exceeds a prescribed length of time. The ink volume timer 95 is configured to be capable of supplying an amount of ink which is larger than an amount of ink that is supplied for usual printing operations (second and proceeding printing operations). The amount of ink supplied at this time is an aggregation of an average amount of ink, which is held in the inner surface of the stencil paper 18 after a printing operation is completed, and some added amount. Furthermore, the CPU 91 controls the retrieving from, and the writing in, a ROM 97 and a RAM 98. While in a stencil making mode and in a printing mode, the CPU 91 performs processing in compliance with a flowchart shown in FIG. 9. The contents of the flowchart will be described in relation to functions described below.

Next, operations of the stencil printing machine will be described on a basis of FIG. 9.

First, users chooses a stencil making mode through the selection key 92 for choosing between a stencil making mode and a printing mode (Step S1). The stencil making unit 2 loads the stencil paper 18 by the rotations of the platen roller 21 and the stencil loading rollers 22 and 22. The stencil paper is perforated according to heat sensitiveness in a way that a plurality of heat generators of the thermal print head 20 performs selective operations of generating heat based on image data acquired by the original scanning unit 1. This stencil paper 18 is cut by a stencil cutter 24, and made, into a stencil paper 18 of a desired length (Step S2). In the printing unit 3, the edge of the stencil paper 18 which has been made by the stencil making unit 2 is clamped by the stencil clamping unit 27 of the printing drum 26, and the stencil paper 18 is mounted on the outer peripheral wall 53 of the printing drum 26 by rotating the outer peripheral wall 53 of the printing drum 26 in a state that the edge of the stencil paper is clamped (Step S3).

Second, an initial printing operation is performed. Specifically, the ink volume timer 95 controls operations of the ink pump 58, and thus causes the ink pump 58 to operate for a prescribed length of time. By this, the ink pump 58 supplies a prescribed amount of ink from the ink supplying outlets 55*a* to the outer peripheral wall 53 (Steps S4 and S5). This supplied ink 56 is held in-between the outer peripheral wall 53 and the stencil paper 18.

Third, the outer peripheral wall 53 of the printing drum 26 is caused to rotate at a speed which is slower than a speed at which usual printing operations are performed (second and proceeding printing operations are performed)(Step S6). The print sheet 37 is fed while being synchronized with the rotation of this drum 26, and then the pressure roller 35 is caused to provide displacement from the resting position to the pressing position (Steps S7 and S8). Hereafter, the fed print sheet 37 is pressed against the outer peripheral wall 53 of the printing drum 26 by the pressure roller 35, and concurrently is fed, while being pressed, by the rotation of the outer peripheral wall 53 of the printing drum 26.

Figure 10:
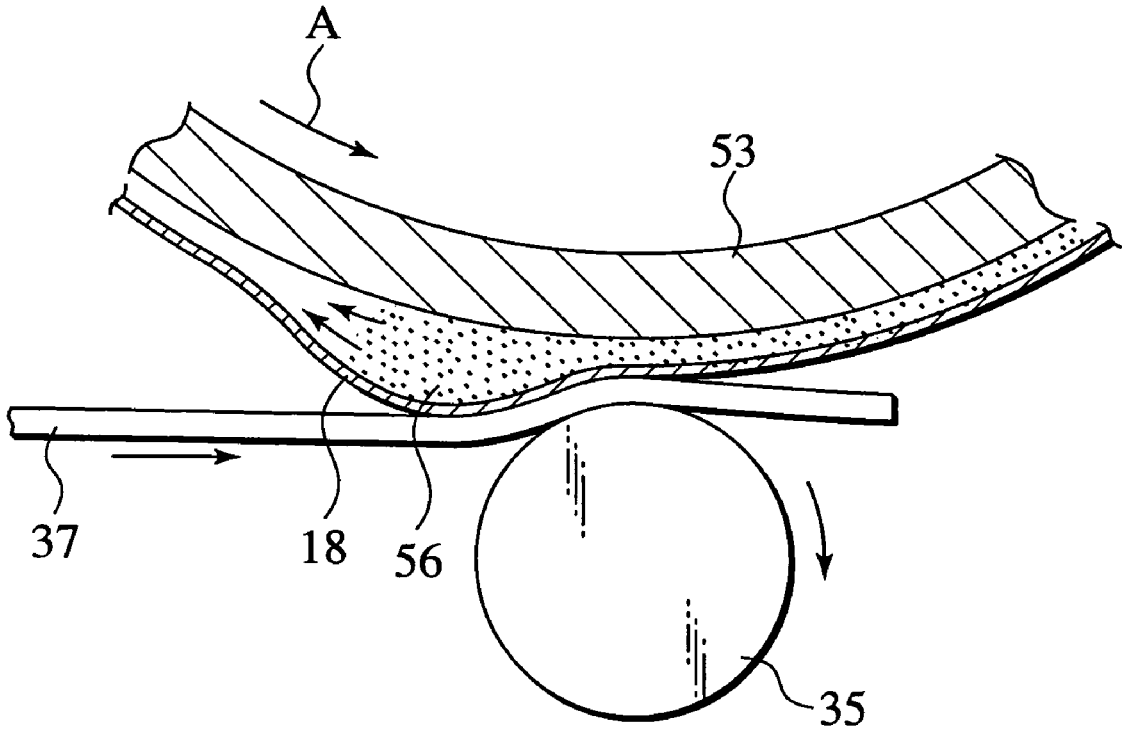
FIG. 10 is a partial, cross sectional view to describe a mechanism of dispersing ink, and to show the embodiment of the present invention.

In concurrence with the transferring of the print sheet 37, as shown in FIG. 10, ink 56 held between the outer peripheral wall 53 of the printing drum 26 and the stencil paper 18 is spread downstream in the printing direction M while being squeezed through in-between by the pressure caused by the pressure roller 35. Accordingly, the spread ink 56 transudes out of pores in the stencil paper 18, and is transferred onto the print sheet 37. In the above described way, an image is printed onto the print sheet 37 while in the process of being passing between the outer peripheral wall 53 of the printing drum 26 and the pressure roller 35. With regard to the print sheet 37 which has come out between the outer peripheral wall 53 of the printing drum 26 and the pressure roller 35, the extremity thereof is taken off the printing drum 26 by a sheet separator 44. The print sheet 37 which has been separated away from the printing drum 26 is discharged onto a paper receiving tray 46 through a transferring passage 45.

If a continuous printing mode is not chosen through the selection key 93 for choosing a continuous operating mode (Step S9), the printing drum 26 is caused to stop rotating, and the pressure roller 35 is caused to return to from the pressing position to the resting position (Step S10). On the contrary, if a continuous printing mode is chosen through the selection key 93 for choosing a continuous operating mode, the stencil printing machine is placed in a mode of usual printing operations (second and proceeding printing operations). While in a mode of usual printing operations, the ink pump 58 for supplying ink and the ink pump 78 for recovering ink are caused to being always operating, and the above described printing operation is performed by causing the outer peripheral wall 53 of the printing drum 26 to rotate at a speed designated for usual printing operations. When the printing of a prescribed number of print sheets is completed, the outer peripheral wall 53 of the printing drum 26 is caused to stop rotating, and concurrently the ink pumps 58 and 78 are caused to stop operating. By this, the supply of ink 56 to the outer peripheral wall 53 is caused to stop. In addition, the pressure roller 35 is caused to return from the pressing position to the resting position, and is placed in a resting mode.

When a printing operation is completed, the timer 96 for measuring a time period for which the printing drum has been left as it is starts to measure the time. Hereafter, when users choose a printing mode through the selection key 92 for choosing between a stencil making mode and a printing mode (Step S1), the timer 96 for measuring a time period for which the printing drum has been left as it is ceases to measure the time, and checks whether or not a time period for which the printing drum 26 has been left as it is exceeds a prescribed length of time t (Step S11). If the time period for which the printing drum 26 has been left as it is exceeds the prescribed length of time t, only the first one page of print sheets is printed with the same mode of operation in which the above described initial printing operation is made (S12 through S15). In other words, before the outer peripheral wall 53 of the printing drum 26 is caused to start rotating, a prescribed amount of ink to be supplied is supplied from the ink supplying outlets 55*a* to the outer peripheral wall 53, and the printing drum 26 is caused to operate at a speed which is slower than a speed at which usual printing operations are performed. In this way, the printing operation is performed. For the second and proceeding printing operations, the stencil printing machine is placed in a mode of usual printing operations (Step S16). When the printing of a prescribed number of print sheets is completed, the stencil printing machine is placed in a resting mode.

When a mode of discharging a stencil paper is chosen in order to do such as start to make a new stencil paper, the stencil clamping unit 27 of the printing drum 26 is caused to provide displacement to a place in which the clamping is released. Accordingly, the extremity of the stencil paper 18 which has been released from the state of being clamped is guided by the discharged stencil transferring unit 47 in correspondence with the rotation of the printing drum 26, and eventually the stencil paper is contained in the stencil disposal box 48.

As described above, in the stencil printing machine, when an initial printing operation is performed after the stencil paper is mounted on the printing drum, the inner surface of the stencil paper 18 is supplied with an amount of ink 56 which is larger than an amount of ink which is supplied for usual printing operations. Since this ink 56 is spread downstream in the printing direction M by being squeezed through by the pressure roller 35, the ink 56 covers the entire printing surface. Accordingly, even though the printing drum 26 has been left as it is for a long time, a printed sheet which does not include places that are not fully printed is available at a time when an initial printing operation is performed. As a consequence, waste of print sheets 37 can be avoided.

With regard to the above described stencil printing machine, if the printing drum 26 is left as it is for a long time, ink on the surface of the printing drum transudes out through pores in the stencil paper 18 or does other things. If, however, the time period for which the printing drum 26 has been left as it is exceeds the prescribed length of time t, the inner surface of the stencil paper 18 is supplied, for the initial printing operation, with an amount of ink 56 which is larger than an amount of ink that is supplied for usual printing operations. Since this ink 56 is spread downstream in the printing direction M by being squeezed through by the pressure roller 35, the ink 56 can be spread over the entire surface to be printed on. Accordingly, even if the printing drum 26 is left as it is for a long time, a printed sheet which does not include places that is not fully printed can be available at a time when an initial printing operation is performed after a stencil paper is mounted on the printing drum. As a consequence, waste of print sheets 37 can be avoided.

In addition, in an embodiment of the present invention, an amount of ink which is supplied when an initial printing operation is performed after the stencil paper has been mounted on the printing drum or after the printing drum has been left as it is for along time is an aggregation of an average amount of ink, which is held in the inner surface of the stencil paper 18 after a printing operation is completed, and some added amount. In other words, the amount of ink which is supplied when an initial printing operation is performed is almost equivalent to an aggregation of an amount of ink which is held in the inner surface of the stencil paper 18 after being squeezed through by the pressure roller 35 and an amount of ink which is transferred onto a print sheet 37. This means that a sufficient amount of ink is supplied at a time of an initial printing operation. As a consequence, a printed sheet which does not include places that are not fully printed can be available even when an initial printing operation is performed.

The added amount of ink is allowed to be different between an initial printing operation after a stencil paper is mounted on the printing drum and an initial printing operation after the printing drum has been left as it is for a long time. In a case that the printing drum has been left as it is for a long time, an amount of ink to be supplied may be varied depending on a time period for which the printing drum has been left as it is.

In the embodiment of the present invention, in the course of an initial printing operation to be performed after a stencil paper is mounted on the printing drum or after the printing drum has been left as it is for a long time, the initial printing operation is performed by causing the printing drum 26 to rotate at a speed which is slower than a speed at which usual printing operations are performed. This allows sufficient time for which ink 56 that has been supplied between the outer peripheral wall 53 of the printing drum 26 and the stencil paper 18 is spread downstream in the printing direction M while being squeezed through by the pressure of the pressure roller 35. Concurrently, this allows sufficient time for which this spread ink 56 transudes out of pores in the stencil paper 18 towards the print sheet 37. Accordingly, a printed sheet which does not include places that is not fully printed can be surely available.

In the embodiment, the ink recovering mechanism 73 for recovering ink which leak out of the maximum printing area S of the outer peripheral wall 53 is provided. Accordingly, an excessive amount of ink can be removed from the outer peripheral wall 53 of the printing drum 26, and concurrently can be recycled. In addition, ink which has been pooled in the grooves 71*a*, 71*b* and 71*c* for preventing ink leak can be recovered, a situation in which ink overflows from the grooves 71*a*, 71*b* and 71*c* for preventing ink leak can be avoided.

In the embodiment, the ink container 57 for supplying ink and the recovering container 79 for recovering ink are provided. For this reason, recovered ink may not necessarily be recycled.

In the embodiment, the filter 80 is placed in the middle of the fourth pipe 77 of the ink recovering mechanism 73, and thus ink 56 which is not contaminated with paper dust can be surely returned to the recovering container 79. This contributes to improving the quality of recycled ink. The ink filter 80, however, is not an essential item for recycling ink. An embodiment without the filter provided can be also acceptable.

In the embodiment, if control is made so as to cause the ink supplying mechanism 54 and ink recovering mechanism 73 to always operate while in a printing mode, ink is supplied uninterruptedly from the ink supplying unit 55A to the outer peripheral wall 53 while in a printing mode, and thus ink which flows from the outer peripheral wall 53 into the grooves 71*a*, 71*b* and 71*c* for preventing ink leak is always recovered. This prevents ink from remaining on the outer peripheral wall 53 as much as possible. In addition, an adequate amount of ink can be always held on the outer peripheral wall 53. Accordingly, even when a large quantity of printings is performed in succession, printed sheets which are prepared with a desired concentration of ink can be available.

Incidentally, the ink recovering mechanism 73 of the embodiment uses the grooves 71*a*, 71*b* and 71*c* for preventing ink leak as grooves for recovering ink. It should be noted, however, that ink recovering grooves may be constructed in a place other than the place in which the grooves 71*a*, 71*b* and 71*c* for preventing ink leak are arranged, preferably in a place outside the place in which the grooves 71*a*, 71*b* and 71*c* for preventing ink leak are arranged. Otherwise, only ink recovering grooves may be constructed instead of constructing the grooves 71*a*, 71*b* and 71*c* for preventing ink leak.

According to the embodiment, the grooves 71*a*, 71*b* and 71*c* for preventing ink leak are constructed to surround the entire outer periphery of the maximum printing area S of the outer peripheral wall 53, as if forming the sides of a rectangle. Even if the grooves are constructed only in a part of the outer periphery of the maximum printing area S, it serves for the object. In other words, the construction includes only the grooves 71*a* for preventing ink leak which are located in the sides, or only the groove 71*b* for preventing ink leak which is located in the end, or only the groove 71*c* for preventing ink leak which is located in the top, or only a combination of each two of the grooves for preventing ink leak. If the grooves 71*a* for preventing ink leak which are located in the sides are formed, ink leak from both sides of the printing drum 26 can be prevented. If the groove 71*b* which is located in the end is formed, ink leak from the end of the printing drum can be prevented. If the groove 71*c* which is located in the top is formed, ink leak from the top of the printing drum can be prevented.

Figure 11:
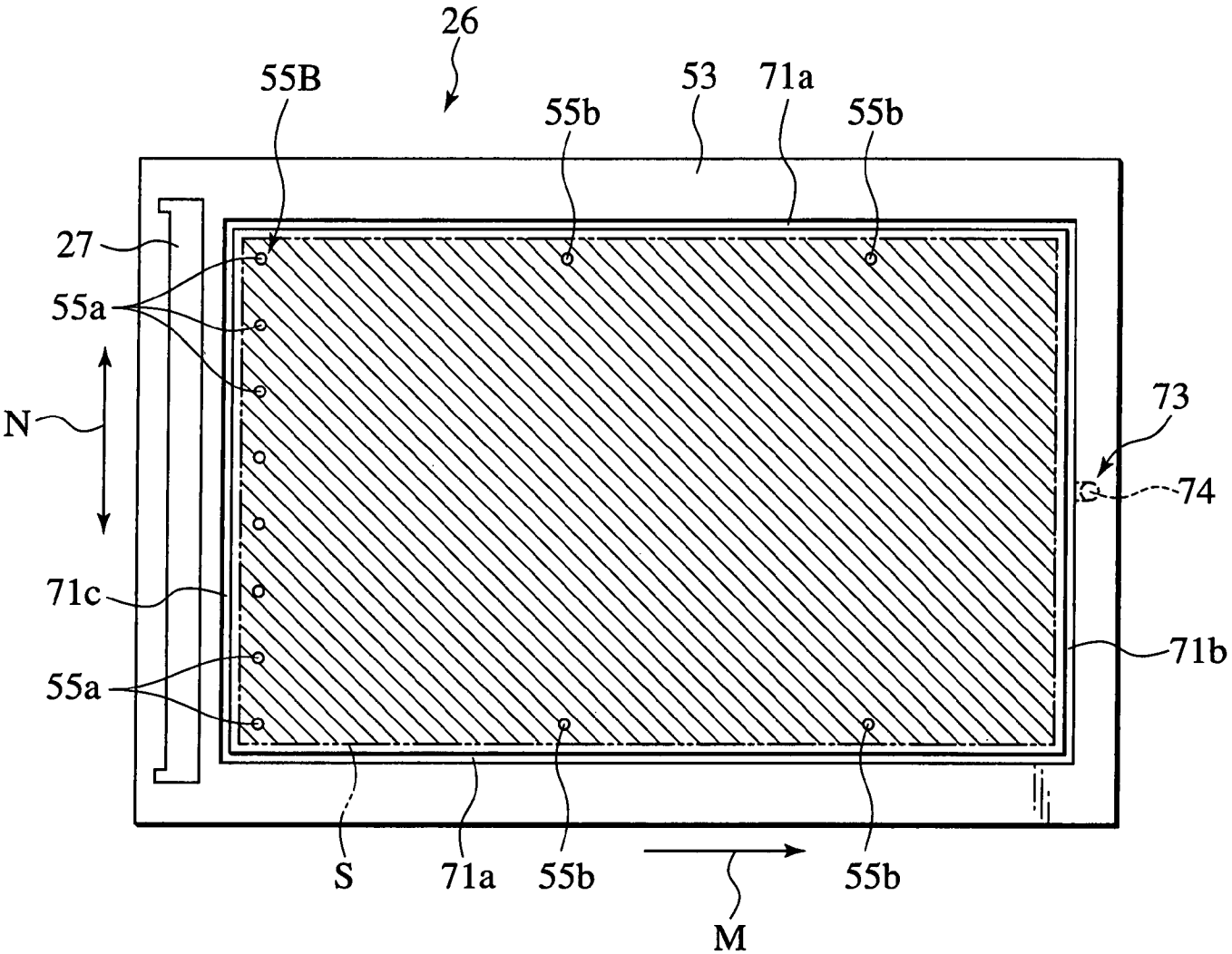
FIG. 11 is an expanded view of the outer peripheral wall of the printing drum to show a first modification of the embodiment of the present invention.

FIG. 11 is shows a first modification of the embodiment of the present invention, and is an expanded view of the printing drum.

In FIG. 11, as in the case of the embodiment, an ink supplying unit 55B includes ink supplying outlets 55*a*, which have a constitution similar to those used for the fist embodiment, and which is arranged in a most upstream position of the printing inside the maximum printing area S of the outer peripheral wall 53. In addition, the ink supplying unit 55B include ink supplying outlets 55*b* which are arranged at both the right and left side edges in the downstream position of the printing from the most upstream position of the printing inside the maximum printing area S, which is located on the outer peripheral wall 53 of the printing drum 26.

Incidentally, since other constitutions are the same as those used for the above described embodiment, detailed description is omitted in order to avoid repeated description.

According to the first modification, while ink is being squeezed through downstream by the pressure roller 35, part of the ink is squeezed out of both right and left side edges of the maximum printing area S. In some cases, as the ink is squeezed through downstream of the maximum printing area S further and further, an amount of ink goes insufficient in both right and left side edges. For this reason, ink is configured to be additionally supplied from the vicinity of both edges downstream. Accordingly, in no case does ink go insufficient in the vicinity of both edges downstream. As a result, unevenness of print concentration in the direction N orthogonal to the printing direction M can be surely avoided.

Figure 12:
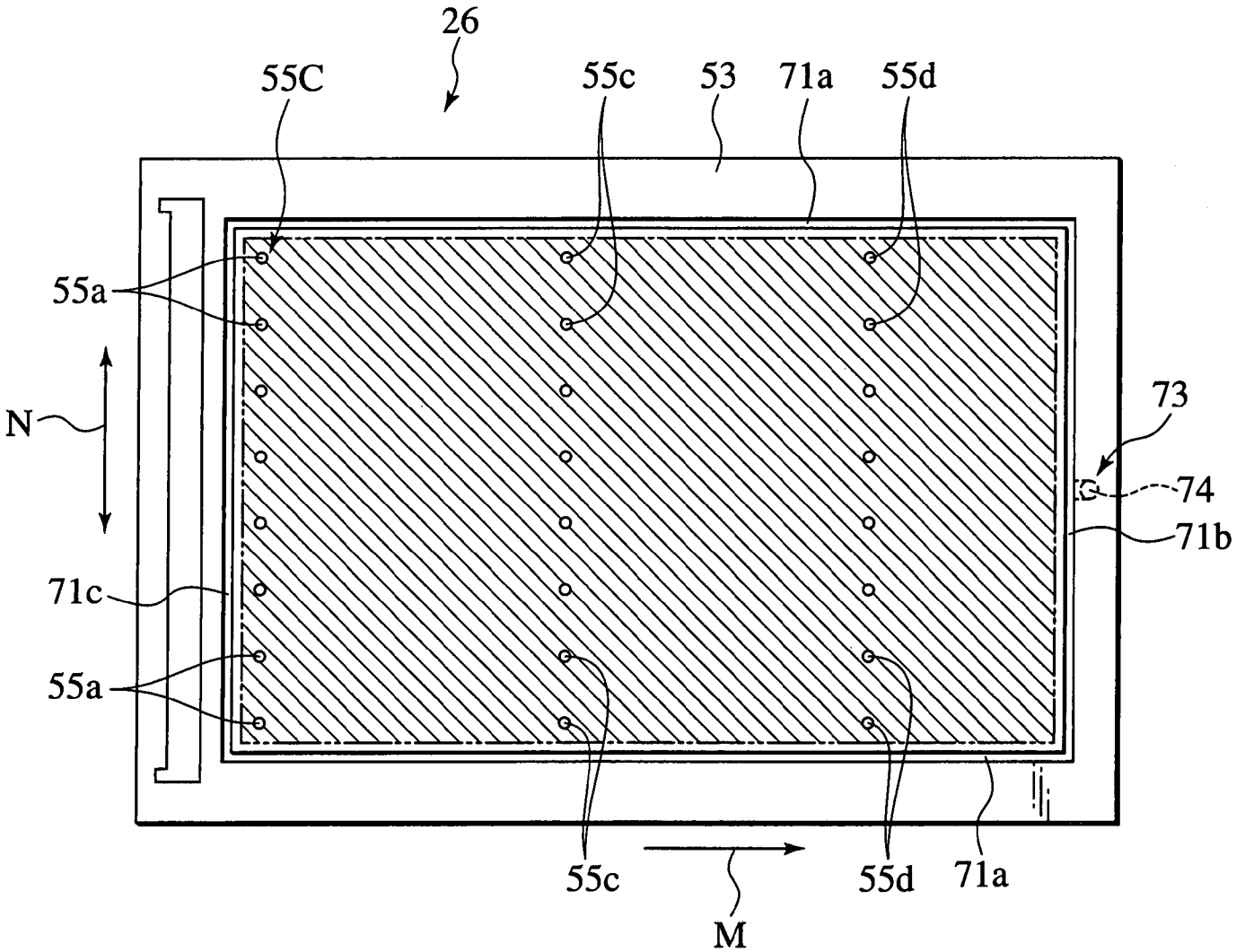
FIG. 12 is an expanded view of the outer peripheral wall of the printing drum to show a second modification of the embodiment of the present invention.

FIG. 12 shows a second modification of the embodiment of the present invention, and is an expanded view of the outer peripheral wall of the printing drum.

As shown in FIG. 12, an ink supplying unit 55C includes ink supplying outlets 55*a* in the most upstream portion of the printing, which is obtained by dividing the maximum printing area S in the outer peripheral wall 53 of the printing drum 26 into three blocks in the direction downstream of the printing, and which responds to a place similar to that of the above described embodiment. The ink supplying unit 55C also include ink supplying outlets 55*c* and 55*d* in the upstream position of the respective blocks which are located downstream of the most upstream block. The ink supplying outlets 55*a*, 55*b* and 55*c* which are arranged in the respective three blocks are constructed to be open in intervals equal to one another in the direction N orthogonal to the printing direction M in the outer peripheral wall 53.

In the second modification, if the ink supplying outlets 55*a*, 55*c* and 55*d*, which are located in the respective three blocks, supply an amount of ink which is needed for use in each block instead of for use in the entire printing area, it serves for the object. For this reason, a lump of ink, if formed between the stencil paper 18 and the outer peripheral wall 53, could be minimized while the ink is squeezed through by the pressure roller 35. As a consequence, load cast on the stencil paper 18 could be reduced, and thus the durability of a stencil paper 18 against repeated use for printing could be improved.

What is claimed is:

1. A stencil printing machine, comprising:

a rotatable printing drum including an outer peripheral wall of ink impermeable material, wherein a stencil paper is mounted on the surface of the outer peripheral wall;

an ink supplying mechanism including an ink supplying unit in the outer peripheral wall of the printing drum, configured to supply ink from the ink supplying unit to the surface of the outer peripheral wall;

a pressure roller configured to press a fed print medium against the outer peripheral wall;

an ink volume timer for measuring a time needed for supplying ink; and a controller, for initial printing operation after stencil paper is mounted on the printing drum, for supplying an amount of ink which is larger than an amount of ink which is supplied for second and proceeding printing operations based on time data from the ink volume timer while rotating the printing drum at a speed which is slower than a speed at which second and proceeding printing operations are performed.

2. The stencil printing machine according to claim 1, wherein an amount of ink which is supplied for an initial printing operation after a stencil paper is mounted on the printing drum is larger than an average amount of ink which is held in the inner surface of a stencil paper after an printing operation is completed.

3. The stencil printing machine according to claim 1, wherein the ink supplying unit is configured to supply ink between the stencil paper and the surface of the outer peripheral wall from the inside of the printing drum without exposing the ink to the atmosphere.

4. The stencil printing machine according to claim 1, wherein the ink supplying mechanism includes a conduit configured to supply ink to the ink supplying unit from the inside of the printing drum without exposing the ink to the atmosphere.

5. A stencil printing machine, comprising:

a rotatable printing drum including an outer peripheral wall of ink impermeable material, wherein a stencil paper is mounted on the surface of the outer peripheral-wall;

an ink supplying mechanism including an ink supplying unit in the outer peripheral wall of the printing drum, configured to supply ink from the ink supplying unit to the surface of the outer peripheral wall; and a pressure roller configured to press a fed print medium against the outer peripheral wall;

an ink volume timer for measuring a time needed for supplying ink;

a timer for measuring a time period for which the printing drum has been left as it is; and a controller, for initial printing operation after a time period from a time at which the printing drum is caused to stop operating through a time at which the initial printing operation is started exceeds a prescribed length of time, for supplying an amount of ink which is larger than an amount of ink which is supplied for second and proceeding printing operations based on time data from the ink volume timer and the timer while rotating the printing drum at a speed which is slower than a speed at which second and proceeding printing operations are performed.

6. The stencil printing machine according to claim 5, wherein an amount of ink which is supplied for an initial printing operation after the printing drum has been left as it is for along time is larger than an average amount of ink which is held in the inner surface of a stencil paper after an printing operation is completed.

* * * * *